US006777864B2

(12) United States Patent
Reed et al.

(10) Patent No.: US 6,777,864 B2
(45) Date of Patent: Aug. 17, 2004

(54) TENSION MASK FOR A CATHODE-RAY TUBE WITH IMPROVED VIBRATION DAMPING

(75) Inventors: Joseph Arthur Reed, York, PA (US); Gary Lee Diven, Lancaster, PA (US)

(73) Assignee: Thomson Licensing S.A., Boulogne-Billancourt (FR)

( * ) Notice: Subject to any disclaimer, the term of this patent is extended or adjusted under 35 U.S.C. 154(b) by 135 days.

(21) Appl. No.: 09/797,229

(22) Filed: Mar. 1, 2001

(65) Prior Publication Data

US 2002/0149309 A1 Oct. 17, 2002

(51) Int. Cl.[7] ..... H01J 29/81
(52) U.S. Cl. ..... 313/407; 313/402
(58) Field of Search ..... 313/402, 403, 313/407, 408; 430/25

(56) References Cited

U.S. PATENT DOCUMENTS

| | | | | |
|---|---|---|---|---|
| 5,067,678 A | | 11/1991 | Henneberger et al. | |
| 5,160,811 A | | 11/1992 | Ritzmann | |
| 5,161,580 A | | 11/1992 | Klug | |
| 5,240,209 A | | 8/1993 | Kutsch | |
| 5,271,585 A | | 12/1993 | Zetena, Jr. | |
| 5,316,243 A | | 5/1994 | Henneberger | |
| 5,316,244 A | | 5/1994 | Zetena, Jr. | |
| 5,335,349 A | | 8/1994 | Kutsch et al. | |
| 5,503,354 A | | 4/1996 | Lohf et al. | |
| 5,610,473 A | * | 3/1997 | Yokota et al. | 313/402 |
| 5,752,781 A | | 5/1998 | Haataja et al. | |
| 5,923,753 A | | 7/1999 | Haataja et al. | |
| 5,937,131 A | | 8/1999 | Haataja et al. | |
| 5,995,699 A | | 11/1999 | Vargas et al. | |
| 6,037,538 A | | 3/2000 | Brooks | |
| 6,076,779 A | | 6/2000 | Johnson | |
| 6,356,010 B1 | * | 3/2002 | Nakamura | 313/402 |
| 2002/0079805 A1 | * | 6/2002 | Michalchuk | 313/402 |

OTHER PUBLICATIONS

ADC Telecommunications brochure entitled "FiberGuide® Fiber Management Systems," 33 pages, dated Oct., 1995.
Warren & Brown & Staff brochure pages entitled "light-paths," Issue 2, 11 pages, dated 1995.
ADC Telecommunications brochure entitled "Fiber Guide™ Fiber Management System," 6 pages, dated Jun., 1989.
ADC Telecommunications brochure entitled "ADC Fiber-Guide® System Express Exit™ 2×2," 2 pages, dated 5/99.
ADC Telecommunications brochure entitled " FiberGuide® Fiber Management Systems," 37 pages, dated 6/98.
ADC Telecommunications catalog entitled "Fiber Panel Products," Second Edition, dated 7/96.

* cited by examiner

*Primary Examiner*—Vip Patel
*Assistant Examiner*—Glenn Zimmerman
(74) *Attorney, Agent, or Firm*—Joseph S. Tripoli; Carlos M. Herrera; Patricia A. Verlangieri

(57) ABSTRACT

The present invention provides a tension mask having a frequency distribution with improved vibration damping. The tension mask includes a center portion between two edge portions. The tension mask also has a parabolic frequency distribution between the edge portions whereby the center portion has a central frequency distribution value and the edge portions have a relatively lower peripheral frequency distribution value characterized in that the range of variation between the center and edge portions frequency distribution value is in the closed interval of about 8 Hz≦Δ≦12 Hz.

4 Claims, 7 Drawing Sheets

300

MODAL SHAPES FOR VARIOUS MASK TENSION DISTRIBUTIONS

500

600

FREQUENCY DISTRIBUTIONS: NOVEL MASK VS. PRIOR ART

TENSION MASK FOR A CATHODE-RAY TUBE WITH IMPROVED VIBRATION DAMPING

This invention generally relates to cathode ray tubes and, more particularly, to a tension mask having a frequency distribution with improved vibration damping.

BACKGROUND OF THE INVENTION

A color picture tube includes an electron gun for forming and directing three electron beams to a screen of the tube. The screen is located on the inner surface of the faceplate of the tube and comprises an array of elements of three different color emitting phosphors. An aperture mask is interposed between the gun and the screen to permit each electron beam to strike only the phosphor elements associated with that beam. The aperture mask is a thin sheet of metal, such as steel, that is contoured to somewhat parallel the inner surface of the tube faceplate. An aperture mask may be either formed or tensioned.

The aperture mask is subject to vibration from external sources (e.g., speakers near the tube). Such vibration varies the positioning of the apertures through which the electron beams pass, resulting in visible display fluctuations. Ideally, these vibrations need to be eliminated or, at least, mitigated to produce a commercially viable television picture tube.

SUMMARY OF THE INVENTION

The present invention provides a tension mask for a cathode-ray tube having a center portion between two edge portions and a parabolic frequency distribution between the edge portions. The center portion has a central frequency distribution value and the edge portions have a relatively lower peripheral frequency distribution value characterized in that the range of variation between the center and edge portions frequency distribution value is in the closed interval of about 8 Hz$\leqq\Delta\leqq$12 Hz

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
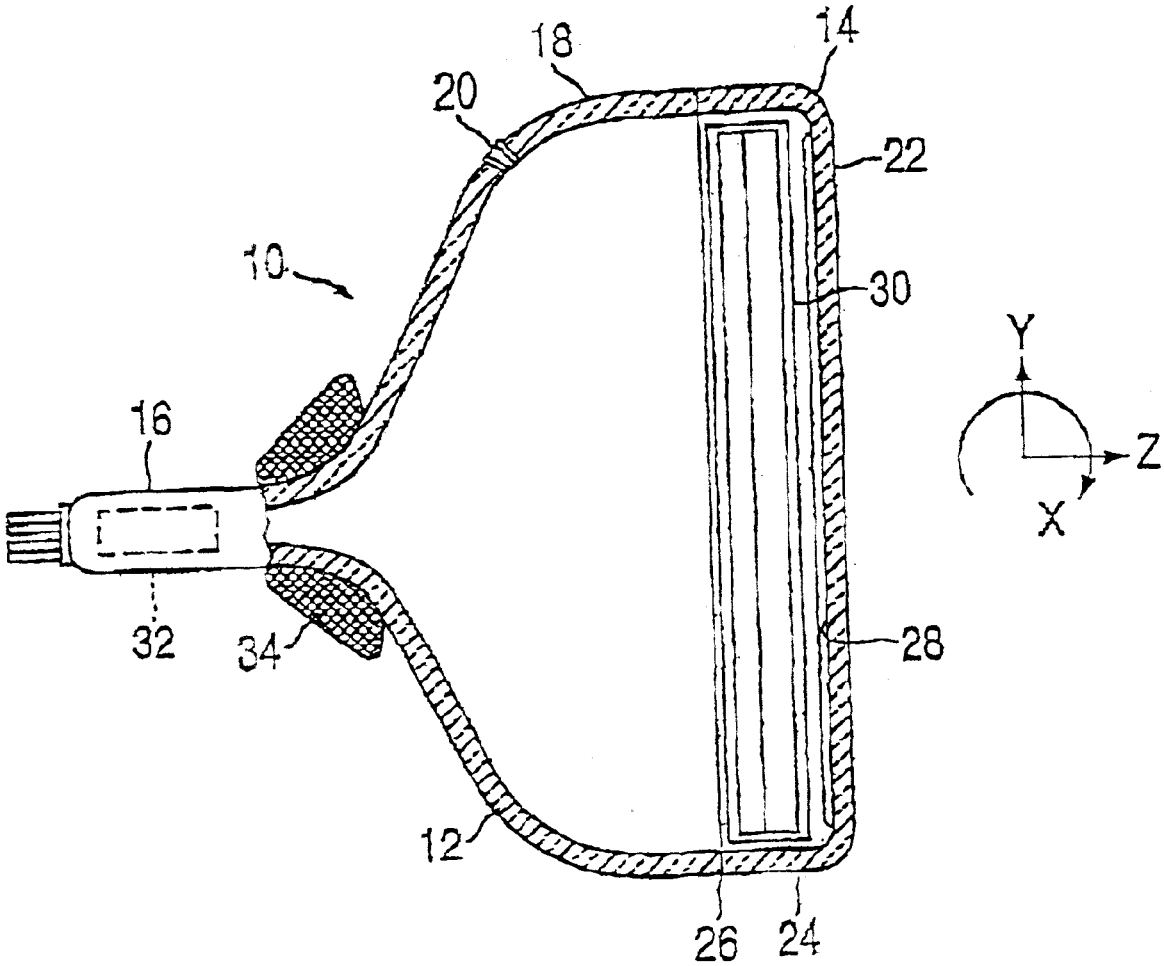
FIG. 1 is a side view, partly in axial section, of a color picture tube, including a tension mask-frame-assembly according to the present invention.

FIG. 1 shows a cathode ray tube 10 having a glass envelope 12 comprising a rectangular faceplate panel 14 and a tubular neck 16 connected by a rectangular funnel 18. The funnel 18 has an internal conductive coating (not shown) that extends from an anode button 20 to a neck 16. The panel 14 comprises a viewing faceplate 22 and a peripheral flange or sidewall 24 that is sealed to the funnel 18 by a glass frit 26. A three-color phosphor screen 28 is carried by the inner surface of the faceplate 22. The screen 28 is a line screen with the phosphor lines arranged in triads, each triad including a phosphor line of each of the three colors. A tension mask 30 is removably mounted in a predetermined spaced relation to the screen 28. An electron gun 32 (schematically shown by the dashed lines in FIG. 1) is centrally mounted within the neck 16 to generate three in-line electron beams, a center beam and two side beams, along convergent paths through the mask 30 to the screen 28.

The tube 10 is designed to be used with an external magnetic deflection yoke, such as the yoke 34 shown in the neighborhood of the funnel to neck junction. When activated, the yoke 34 subjects the three beams to magnetic fields that cause the beams to scan horizontally and vertically in a rectangular raster over the screen 28.

Figure 2:
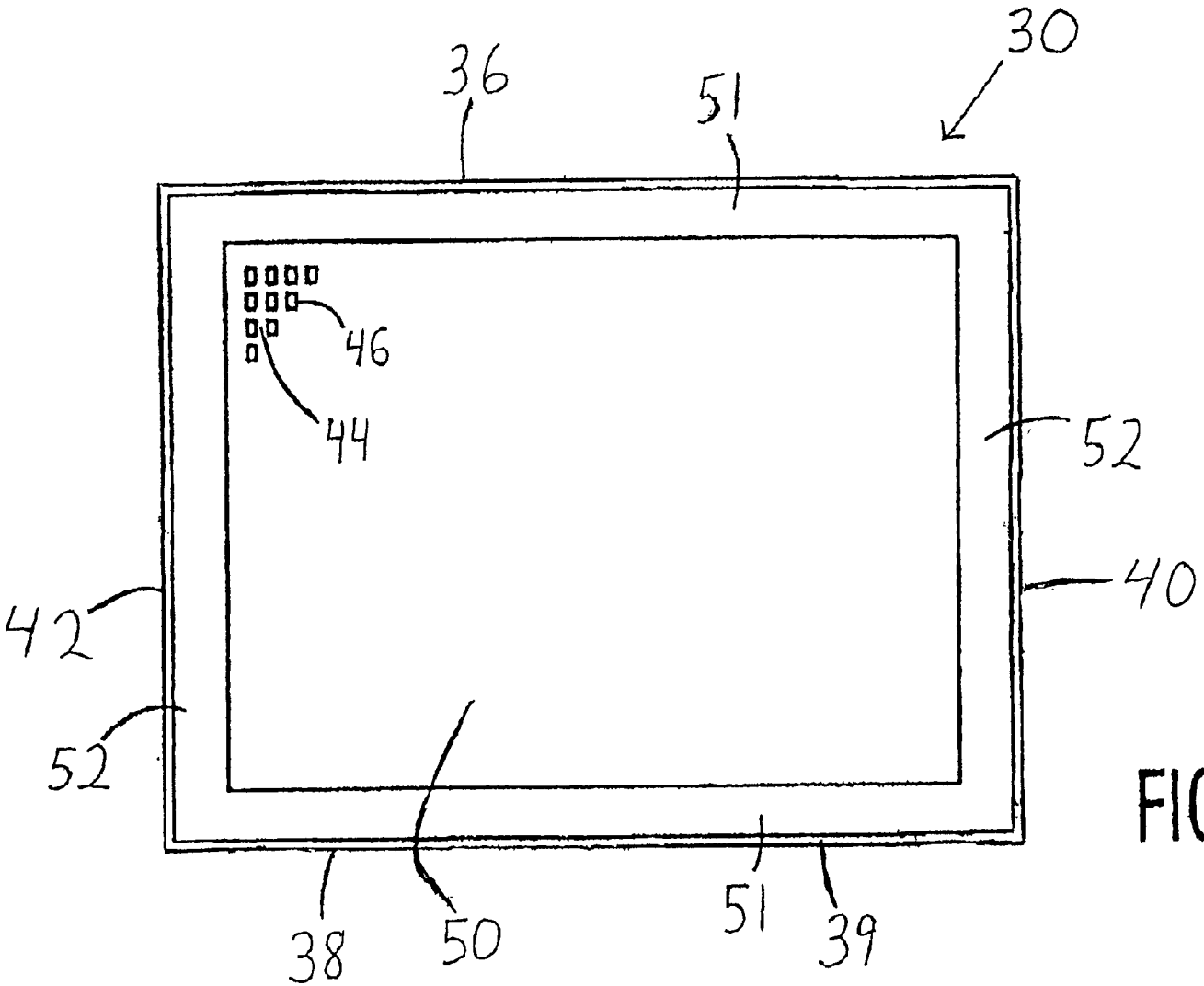
FIG. 2 is a plan view of the tension mask-frame-assembly of FIG. 1 according to an aspect of the invention.

The tension mask 30, shown in greater detail in FIG. 2, is interconnected with a peripheral frame 39 that includes two long sides 36, 38 and two short sides 40, 42. The two long sides 36, 38 of the tension mask 30 parallel a central major axis, X, of the tube. The tension mask 30 includes an apertured portion that contains a plurality of metal strips 44 having a plurality of elongated slits 46 therebetween that parallel the minor axis of the tension mask 30.

Specifically, the apertured portion of tension mask 30 illustrated in FIG. 2 is a tie bar or webbed system. The tension mask 30 has a center portion 50, mask edge portions 52 about 0.5 in. from the edge of the short sides 40, 42 and mask edge portions 51 about 1.0 in. from the edge of the long sides 36, 38. The two mask edge portions 52 are parallel to the tube 10 central minor axis, Y. The two mask edge portions 51 are parallel to the tube 10 central major axis, X. Two mask edge portions 51 are attached to the peripheral frame 39 along the two long sides 36, 38.

The natural frequency distribution across any complete horizontal (central major axis, X) dimension of the tension mask 30 provides a useful way of comparing any tube to any other tube, regardless of size. Effectively, the natural frequency distribution, which is a function of the respective tension distribution and the vertical dimension of the tension mask 30, is a universal metric that dictates microphonic behavior of tubes.

In the preferred embodiment, the natural frequency distribution is a substantially parabolic function that is substantially smooth and continuous. The natural frequency distribution comprises a central frequency distribution for the center portion 50 and peripheral frequency distributions for the edge portions 52, wherein the values of central frequency distribution are constructively greater than the values of the peripheral frequency distribution. The difference between the maximum of central frequency distribution and the minimum of the peripheral frequency distribution is about 10 Hz.

When the center portion 50 is under greater tension than the mask edge portion 52, the condition is called a mask 'frown.' A mask 'frown' has a fundamental mode of vibration that principally involves the edge portion 52 of the mask 30. Border damping systems (BDS), i.e., vibration dampers, can effectively damp vibrational energy because the BDS are triggered by vibrations in the edge portion 52 of the mask 30.

When the center portion 50 is under less tension than the mask edge portion 52, the condition is called a mask 'smile.'

As such, the values of the central frequency distribution are less than the values of peripheral frequency distribution. For a 'smile' condition the damping of vibrations tend to be poor because the vibrating mask 30 has a fundamental mode dominated by the motion of the center portion 50 and does not trigger the BDS.

When the natural frequency distribution is even or flat, the values of the central frequency distribution and the peripheral frequency distribution are substantially similar. This example is difficult to implement. In addition, a slight change in tension distribution caused during manufacture of the tension mask 30 or during cathode ray tube operation could produce a 'smile,' which is undesirable.

Figure 3:
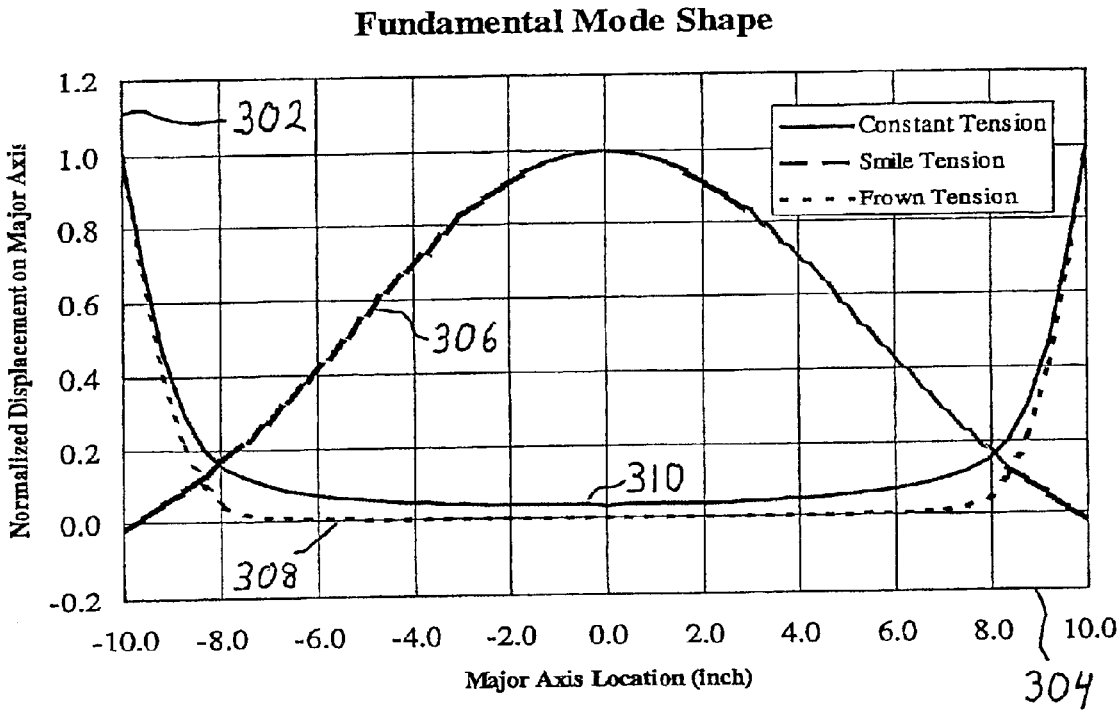
FIG. 3 is a graph depicting modal shapes for various tension distributions.

FIG. 3 is a graph 300 depicting modal shapes for various tension distributions. The graph 300 is defined by normal displacement (axis 302) and major axis location (axis 304). Specifically, the graph 300 shows which portion of the tension mask 30 is excited by vibrations for a flat, 'smile' or 'frown' tension. The tension mask with a 'smile' (plot 306) shows considerably more vibration in the center portion 50 than a tension mask 30 with a 'frown' (plot 308). Additionally, there is more vibration in the center portion 50 of a tension mask 30 having an even tension distribution (plot 310) than for a tension mask 30 having a 'frown.'

A tension mask 30 having a 'frown' has resonant frequencies that are more broadly spaced than a tension mask 30 having a 'smile' or flat distribution. Thus when there is a vibration, energy from the first mode of the disturbance does not feed the second mode, thereby not prolonging the vibrational effect.

A tension distribution in accordance with the present invention producing a parabolic 'frown' in about an 80 Hz to 90 Hz range, the frequency at a given mask location can be represented by equation:

$$f(x) = -\frac{Bx^2}{L^2} + A \qquad \text{Expression 1}$$

The preferred embodiment has the following provisions:

$$92 \geqq A \geqq 88 \qquad \text{Expression 2}$$

$$12 \geqq B \geqq 8 \qquad \text{Expression 3}$$

$$12 \geqq f(x_{max}) - f(x_{min}) \geqq 8 \qquad \text{Expression 4}$$

where f(x) represents the frequency distribution over x, L represents one-half of the total length of tension mask 30 along the major axis, and x represents a major axis position from −L to +L, wherein the absolute value of L is normalized to 1. $f(x_{max})$ and $f(x_{min})$ represent the peak value of the frequency distribution at the center portion 50 and the minimum value the frequency distribution at the edge portion 52, respectively. It is preferred that at least 8 Hz differential be maintained between the frequency distribution at the center portion 50 and edge portion 52 is maintained.

Figure 4:
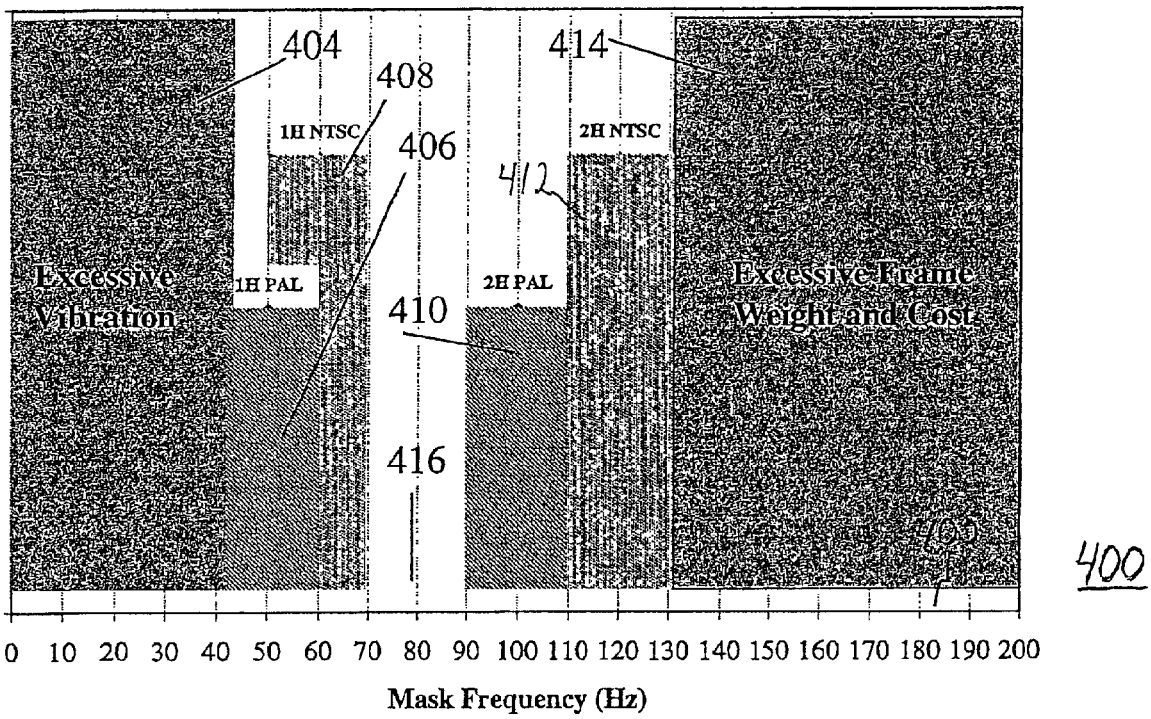
FIG. 4 depicts a bar graph showing mask tension ranges as limited by scan frequencies.

When the mask frequency vibrations occur at a scan frequency or at a harmonic, a beating effect would result, wherein low amplitude modulation become perseptable. FIG. 4 provides some guidance in constructing tension masks with good microphonics performance. The bar graph 400 in FIG. 4 shows mask tension ranges as limited by scan frequencies (axis 402). Specifically, different bars occupy certain scanning frequencies with about a 20 HZ cushion. Excessive vibration (bar 404) occurs in the frequency range of 0 Hz to about 40 Hz. The 50 Hz European television broadcast format 1 H Phase Alternate Line (PAL) (bar 406) excludes the frequency range from about 40 Hz to about 60 Hz. The 60 Hz American television broadcast format 1 H (NTSC) (bar 408) excludes the frequency range from about 50 Hz to about 70 Hz. The 100 Hz European broadcast format 2 H PAL (bar 410) excludes the frequency range from about 90 Hz to about 110 Hz. The 120 Hz American broadcast format 2 H NTSC (bar 412) excludes the frequency range from about 110 Hz to about 130 Hz. To utilize the frequency range from about 130 Hz to about 200 Hz, an excessive frame weight would be required because only such a frame could tension a mask enough to reach these higher frequencies. The graph 400 shows that there is a narrow 20 Hz window (space 416) between 70 Hz and 90 Hz where the mask frequencies are adequately separated from standard scan frequencies and their harmonics.

Furthermore, because vibration amplitude is inversely proportional to mask tension 30, it is desirable to have overall mask tension as high as possible. The 10 Hz edge-to-center differential prescribed in Expression 4 provides a desirable solution to minimizing vibration while preserving the necessary 'frown' tension distribution.

Figure 5:
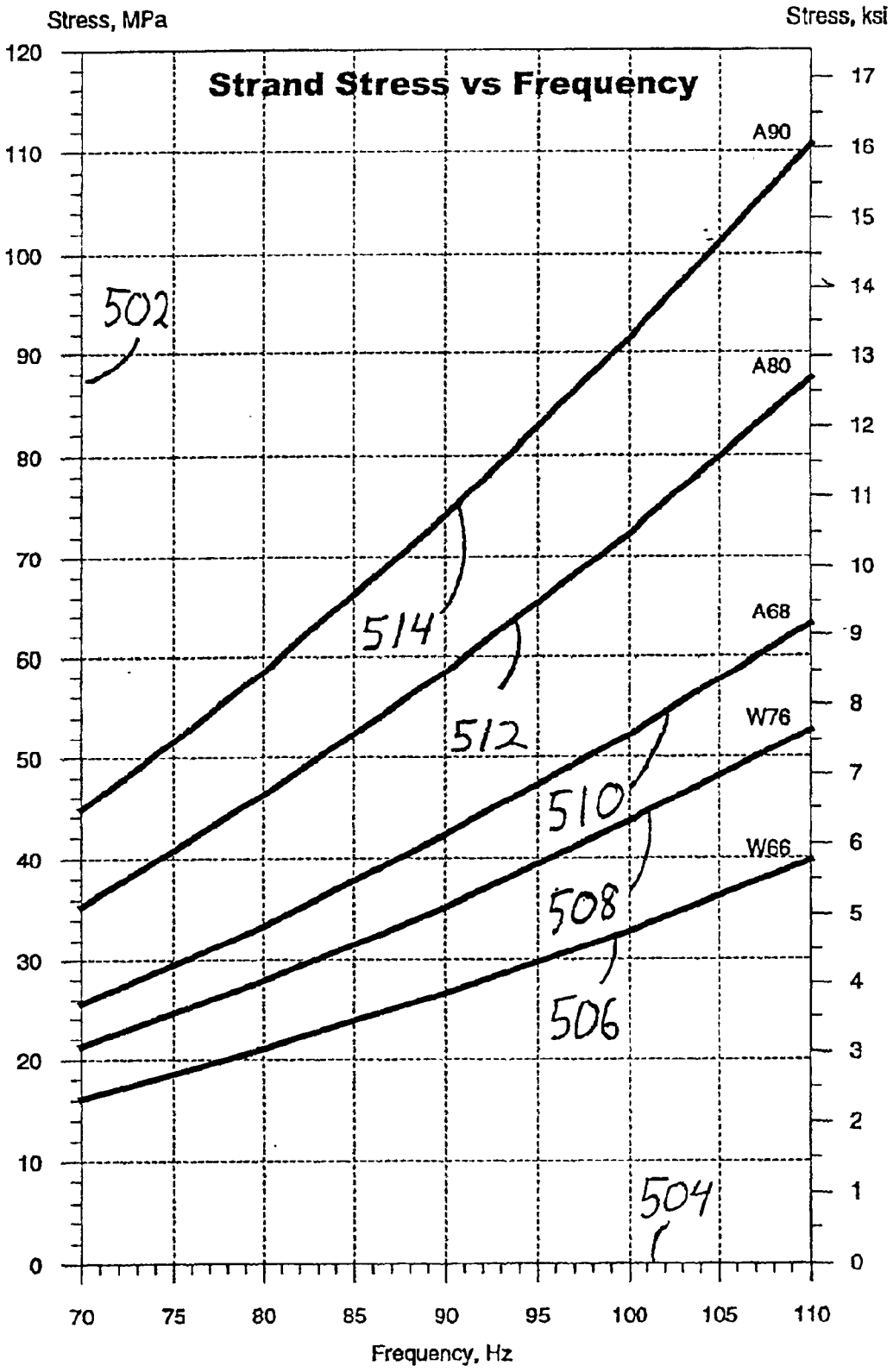
FIG. 5 depicts a graph showing mask stress vs frequency.

FIG. 5 depicts a graph 500 showing mask stress (axis 502) vs frequency (axis 504). Specifically, the graph 500 shows the mask stress (axis 502) vs frequency (504) for different size cathode ray tubes. By varying the stress on the tension mask 30 for various sized tubes, the desired frequency can be attained. The present invention can be practically achieved on all current tube sizes. More specifically, graph 500 depicts a hierarchical relationship among the various size tubes, wherein smaller tubes can achieve the desired frequency distribution with lower mask stress loads than larger tubes. For example, graph 500 shows that an A90 (plot 514) 36 inch size tube experiences greater mask stress (axis 502) at a particular frequency (axis 504) than an A80 (plot 512) 32 inch size tube. The A80 (plot 512) 32 inch size tube experiences greater mask stress (axis 502) than an A68 (plot 510) 27 inch size tube at a particular frequency (axis 504). The A68 (plot 510) 27 inch size tube experiences greater mask stress (axis 502) than a W76 (plot 508) 30 inch cinema screen tube at a particular frequency (axis 504). Finally, the W76 (plot 508) 30 inch cinema screen tube experiences greater mask stress (axis 502) than a W66 (plot 506) 26 inch cinema screen tube at a particular frequency (axis 504).

Figure 6:
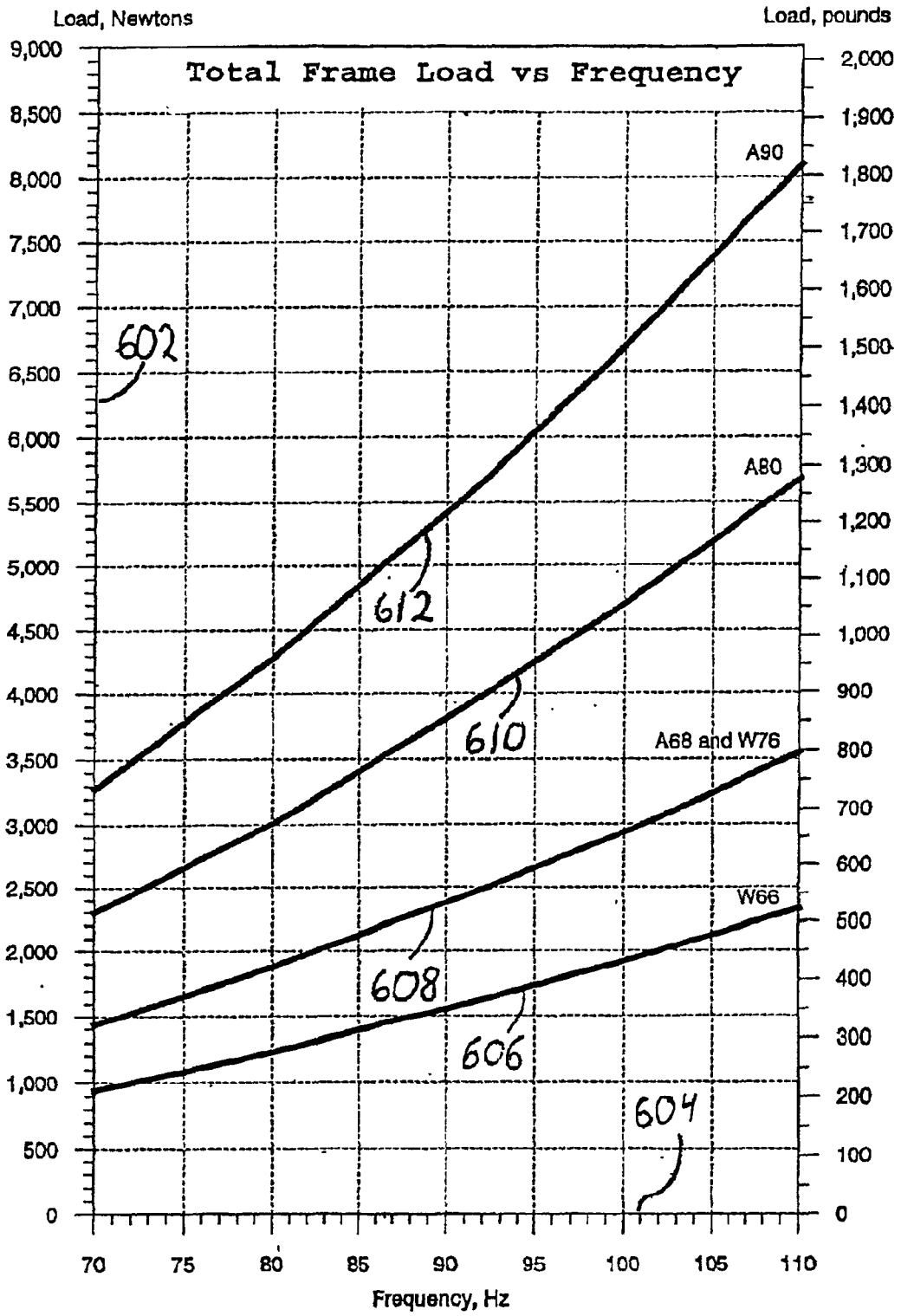
FIG. 6 depicts a graph showing total frame load vs frequency.

FIG. 6 depicts a graph 600 showing total frame load (axis 602) versus frequency (axis 604) for different size cathode ray tubes. The total frame load (axis 602) is the resultant force the tension mask 30 experiences as the two long sides 36, 38 of the peripheral frame 39 apply equal and opposite outward forces, thereby tensioning the center portion 50 and edge portions 52 of the tension mask 30. FIG. 6 shows an A90 36 inch size tube (plot 612) experiences greater total frame load (axis 602) at any frequency (axis 604) compared to an A80 32 inch size tube (plot 610). The A80 32 inch size tube (plot 610) experiences greater total frame load (axis 602) at any frequency (axis 604) compared to an A68 27 inch size tube (plot 608) and W76 30 inch cinema screen tube (plot 608). Finally, the A68 and W76 tubes (plot 608), in turn, experience greater total frame load (axis 602) at any frequency (axis 604) as compared to a W66 26 inch cinema screen tube (plot 606).

Figure 7:
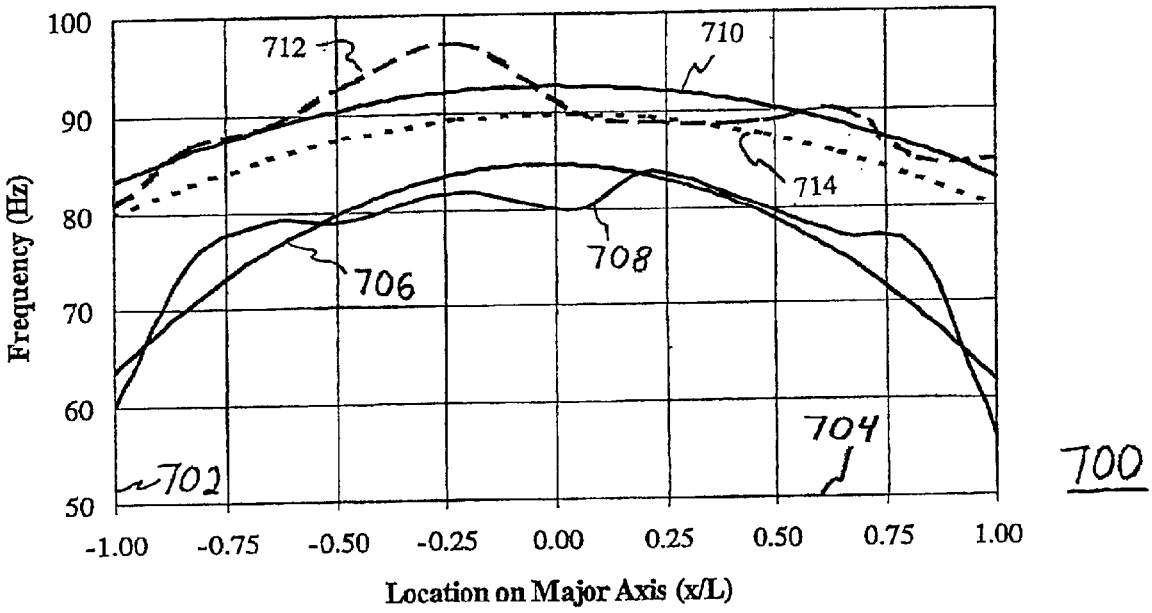
FIG. 7 depicts a graph comparing a prior art tension mask frequency distribution to a tension mask frequency distribution according to the present invention.

FIG. 7 depicts a graph 700 comparing a prior art tension mask frequency (axis 702) and location on major axis (axis 704) to a tension mask frequency (axis 702) and location on major axis (axis 704) according to the present invention. Specifically, the prior art frequency distributions do not follow the frequency distribution of equation 1. More specifically, one prior art frequency distribution (plot 708) approximates the shape of a high order polynomial (plot 706). A second prior art frequency distribution (plot 712) approximates the shape of another high order polynomial (plot 710). A frequency distribution (plot 714) according to the present invention has a parabolic shape and is within the preferred range.

As the embodiments that incorporate the teachings of the present invention have been shown and described in detail, those skilled in the art can readily devise many other varied embodiments that still incorporate these teachings without departing from the spirit of the invention.

What is claimed is:

1. A tension mask for a cathode-ray tube, comprising:

a peripheral frame;

a tension mask affixed to said peripheral frame and having a center portion and edge portions, said edge portions proximate two opposing ends of the tension mask, said center portion having a central frequency distribution, said edge portions having peripheral frequency distributions wherein said central frequency distribution is greater than said peripheral frequency distributions and the frequency distribution from said edge portions to said center portion is represented by a parabolic formula wherein the variational range $\Delta$ between the peak value of the frequency distribution at the center portion and the minimum value of the frequency distribution at the edge portions is in the closed interval of about 8 Hz$\leqq \neq \leqq$12 Hz.

2. The apparatus of claim 1, wherein said central frequency distribution ranges from about 92 Hz to about 88 Hz and said peripheral frequency distributions range from about 76 Hz to about 84 Hz.

3. The apparatus of claim 2, wherein the central frequency distribution is about 90 Hz and the peripheral frequency distribution is about 80 Hz.

4. The apparatus of claim 1, wherein the variational range is about 10 Hz.

* * * * *